US005575204A

United States Patent [19]

Kawai et al.

[11] Patent Number: 5,575,204

[45] Date of Patent: Nov. 19, 1996

[54] DEVICE FOR MOUNTING LEADING END OF STENCIL IN ROTARY STENCIL PRINTER

[75] Inventors: Muneaki Kawai; Hiroshi Watanabe, both of Tokyo, Japan

[73] Assignee: Riso Kagaku Corporation, Tokyo, Japan

[21] Appl. No.: 559,528

[22] Filed: Nov. 17, 1995

[30] Foreign Application Priority Data

Nov. 25, 1994 [JP] Japan ..... 6-315653

[51] Int. Cl.[6] ..... B41L 13/10

[52] U.S. Cl. ..... 101/116; 101/415.1; 101/118; 101/409

[58] Field of Search ..... 101/116, 118, 101/415.1, 409, 410, 411, 412, 117

[56] References Cited

U.S. PATENT DOCUMENTS

| | | | |
|---|---|---|---|
| 1,374,253 | 4/1921 | Tornberg | 101/409 |
| 5,035,175 | 7/1991 | Takita et al. | 101/116 |
| 5,503,075 | 4/1996 | Matsuo et al. | 101/415.1 |

FOREIGN PATENT DOCUMENTS

| | | |
|---|---|---|
| 59-96983 | 6/1984 | Japan . |
| 59-96984 | 6/1984 | Japan . |
| 59-143679 | 8/1984 | Japan . |

OTHER PUBLICATIONS

English–Language abstract of 59–96983.

English–Language abstract of 59–96984.

English–Language abstract of 59–143679.

*Primary Examiner*—Edgar S. Burr
*Assistant Examiner*—Daniel J. Colilla
*Attorney, Agent, or Firm*—Oliff & Berridge

[57] ABSTRACT

To make it possible that the leading end of the stencil proceeds beyond the stencil leading end mounting device toward the stencil exhausting means in the process of exhausting the stencil even when the space required for the open/close operation of the stencil leading end mounting device for mounting the leading end of the stencil to the printing drum of the rotary stencil printer is made small, a snap-up member 84, 86 and 88 is provided adjacent inlet edge of an open/close type clamp member 76 of the stencil leading end mounting device so that the leading end 116 of the stencil released from the clamping by the clamp member 76 in the process of exhausting the stencil is snapped up to the upper side of the clamp member 76.

4 Claims, 10 Drawing Sheets

DEVICE FOR MOUNTING LEADING END OF STENCIL IN ROTARY STENCIL PRINTER

BACKGROUND OF THE INVENTION

1. Field of the Invention

The present invention relates to the field of rotary stencil printer, and more particularly to a device for mounting a leading end of a stencil to the printing drum of a rotary stencil printer.

2. Description of the Prior Art

The stencil printer has now reached a stage of full automatic rotary stencil printer in which the supply of a stencil, perforation thereof, mounting of the perforated stencil to the printing drum, printing and exhausting of the used stencil from the printing drum are all automated such that all those processes of the stencil printing are automatically carried out according to light instructions such as touching a push button by a tip of a finger. A proto-type of the basic construction of such a full automatic rotary stencil printer is disclosed in Japanese Patent Laid-open Publications 59-96983 and 59-143679.

In such a full automatic rotary stencil printer, a sheet to make a stencil is supplied as a band sheet coiled in a role and a predetermined length of the sheet to be mounted around the printing drum is cut out from the band sheet when each one stencil is produced. The leading end of the stencil is mounted to the printing drum by a stencil leading end mounting device comprising a base member having a band surface extending along a portion of a cylindrical outer surface of the printing drum in parallel with a central axis thereof for supporting the leading end of the stencil thereon, and a clamp member having a clamping surface and movable between a closed position where the clamping surface is laid over the stencil leading end supporting surface and an open position where the clamping surface is removed from the stencil leading end supporting surface. In such a stencil leading end mounting device, a most basic construction generally thought of as the clamp member, which, as described above, has a clamping surface and movable between a closed position where the clamping surface is laid over the stencil leading end supporting surface and an open position where the clamping surface is removed from the stencil leading end supporting surface, will be a flat band plate member, and a most basic construction generally thought of as a construction for mounting such a plate member to the printing drum to be movable between the above-described closed and open positions will be to support the band plate member along one of its opposite longer edges by a pivot shaft. In the embodiments of the rotary stencil printer disclosed in the above-mentioned Japanese Patent Laid-open Publications 59-96983 and 59-143679, the stencil leading end mounting device has such a construction.

However, there is a serious problem with respect to the above-mentioned construction of the stencil leading end mounting device of the full automatic rotary stencil printer. As will be understood from the figures of the above-mentioned publications, since the full automatic rotary stencil printer of this type includes three units such as a printing drum, a stencil supply means for supplying a new stencil to the printing drum and a stencil exhausting means for removing and exhausting the used stencil from the printing drum, if these three units are arranged in harmony within as small a space as possible, as a matter of course, the stencil supply means will be placed on one side of the printing drum, while the stencil exhausting means will be place on the other side of the printing drum. In such an arrangement, as viewed from the stencil leading end mounting device the leading end of a new stencil for the mounting approaches thereto from one side thereof, while the leading end of a used stencil is transferred as removed therefrom toward the other side thereof where the stencil exhausting means is positioned. Therefore, when the stencil leading end mounting device has the above-mentioned most basic construction, having a band plate member pivotably mounted along a longer edge thereof to the base member, the plate member may conveniently be inclined at an acute angle toward the stencil supply means like opening a mouth to be ready for receiving the leading end of a new stencil for mounting. In this case, however, it becomes difficult to let the leading end of the used stencil released from the clamping by the plate member proceed beyond the plate member toward the opposite side thereof for exhausting the stencil. Particularly when the used stencil is peeled off from the printing drum starting at the leading end thereof by a tip of a stencil removal claw being engaged into between the outer circumferential surface of the printing drum and the leading end of the stencil, while the printing drum is rotated in the same rotational direction as in the printing operation, as described in the above-mentioned Japanese Patent Laid-open Publications 59-96983 and 59-143679, although such a stencil removal process is desirable for removing the stencil adhered to the outer circumferential surface of the printing drum by the stickiness of the ink, it is important, for such a stencil removal process to be carried out with no problem, that the leading end of the stencil to be exhausted can move beyond the stencil leading end mounting device toward the opposite side thereof, and further that the stencil removal claw does not interfere with the stencil leading end mounting device when it traverses the front of the stencil leading end mounting device during the rotation of the printing drum for the exhaustion of the used stencil.

In view of the above-mentioned two requirements, it was proposed in Japanese Patent Laid-open Publication 59-96984 that, in a stencil leading end mounting device of the above-mentioned basic construction, the clamp member formed as a band plate element is turned from the closed position where one side of the clamp member is laid over the stencil leading end supporting surface of the base member to the open position for about 180°. When a band plate element is turned over for about 180° between the closed and open positions thereof, the movement of the leading end of a new stencil onto the stencil leading end supporting surface of the base member from one side thereof and the movement of the leading end of the stencil away from the stencil leading end supporting surface for exhausting the stencil toward to other side of the stencil leading end supporting surface are both unobstructed, and it is also avoided that the clamp member interferes with the stencil removal claw arranged to position its tip end desirably as close to the outer circumferential surface of the printing drum as possible, provided that the turn over of the clamp member for the approximate 180° is completed before the printing drum is rotated in the same direction as in the printing operation for removing the used stencil therefrom.

However, when the band plate member is turned over for about 180° between the closed and open positions as in the above-mentioned Japanese Patent Laid-open Publication 59-96984, a special space of a semi circular cross section corresponding to the turn over passage of the clamp member must be left vacant only for the turn over of the clamp member such that no other member interferes with the turn over of the clamp member, particularly at a special portion where it is desired that various other members are positioned, thus imposing an undesirable restriction against the compactness of the construction of the stencil printer.

SUMMARY OF THE INVENTION

In view of the above-mentioned problems, it is a principal object of the present invention to provide an improved device for mounting a leading end of a stencil in a rotary stencil printer, such as to have a most compact and reasonable construction, wherein the clamp member formed as a band plate element is pivotably mounted along a longer edge thereof, and nevertheless, the turning angle of the clamp member for the opening and closing thereof need not be such a large angle as about 180° but may be a small acute angle such that a clamp member is slightly removed from the stencil leading end supporting surface of the base member that the clamping of the leading end of the stencil by the clamp member is released, whereby, however, the leading end of the stencil thus released from the clamping by the clamp member can proceed in the opposite direction against the clamp member toward the stencil exhausting means, so that therefore the clamp member, after having released the leading end of the stencil, may again moved to the closed position to avoid interference with the stencil removal claw positioned close to the outer circumferential surface of the printing drum when the printing drum is rotated in the same rotational direction as in the printing operation for the removal of the stencil therefrom.

According to the present invention, the above-mentioned object is accomplished by a device for mounting a leading end of a stencil in a rotary stencil printer, said printer having a printing drum equipped with a base member having a band surface extending along a portion of a cylindrical outer surface of said printing drum in parallel with a central axis thereof for supporting said leading end of the stencil thereon, and a clamp member having a clamping surface and movable between a closed position where said clamping surface is laid over said stencil leading end supporting surface and an open position where said clamping surface is removed from said stencil leading end supporting surface, so that the leading end of the stencil is inserted into a space left between said stencil leading end supporting surface of said base member and said clamping surface of said clamp member across a inlet edge of each of said surfaces when said clamp member is in said open position and is then clamped between said stencil leading end supporting surface of said base member and said clamping surface of said clamp member when said clamp member is moved to said closed position, said device comprising a snap-up member movable between a first position located close to the inlet edge of said stencil leading end supporting surface and a second position close to the inlet edge of said clamping surface of said clamp member positioned at said open position in relation to the movement of said clamp member between said closed and open positions and supply/discharge of the stencil, so that, when the leading end of the stencil is inserted into the space left between said stencil leading end supporting surface and said clamping surface to be mounted to said base member, said snap-up member is positioned at said first position to be on a same side of the leading end of the stencil as said stencil leading end supporting surface, and when clamp member moves to remove said clamping surface away from said stencil leading end supporting surface for releasing the leading end of the stencil clamped between said stencil leading end supporting surface and said clamping surface to exhaust the stencil, said snap-up member moves to said second position so as, at least temporarily, to face a first side of said clamp member opposite to a second side thereof where said clamping surface is provided, thereby moving the leading end of the stencil to said first side of said clamp.

According to the above-mentioned construction, even with a small turn of the clamp member relative to the base member such that the clamp surface of the clamp member is slightly removed from the stencil leading end supporting surface, the released leading end of the stencil is snapped up from the space between the stencil leading end supporting surface and the clamping surface to the upper side of the clamp member opposite to the side of the clamping surface by the snap-up member, and therefore, the leading end of the stencil is positively released from the stencil leading end mounting device by a small opening movement of the clamp member. Therefore, the clamp member may again be closed to be laid over the base member so that the stencil leading end mounting device is flattened to allow a easier movement of the used stencil toward the stencil exhausting means, and also to allow the stencil removal claw to be positioned more close to the outer circumferential surface of the printing drum without interfering with the stencil leading end mounting device when the printing drum is further rotated for removing the used stencil from the printing drum.

In the stencil leading end mounting device of the above-mentioned construction, the snap-up member may comprise a rod portion adapted to provide a linear protuberance bulged out from the stencil leading end supporting surface like a cushion along the inlet edge of the stencil leading end supporting surface when the snap-up member is at said first position. By the snap-up member providing such a cushion-like linear protuberance bulged from the stencil leading end supporting surface along the inlet edge thereof, when the leading end of the stencil is clamped between the base member and the clamp member, a laterally linear part of the stencil passing over the cushion-like linear protuberance along the inlet edge of the stencil leading end supporting surface is curved to follow the linear protuberance before it is tangentially expanded toward the cylindrical outer circumferential surface of the printing drum, so that a high contact pressure is generated between the leading end of the stencil and the linear protuberance, whereby the force of holding the stencil leading end by the stencil leading end mounting device is uniformalized in the lateral direction, accomplishing a width wise uniform mounting of the leading end of the stencil.

In the above-mentioned construction that the snap-up member provides the cushion-like linear protuberance, it is desirable that the surface of the rod portion providing the linear protuberance is applied with a roughing treatment so that the friction coefficient of the rod portion with the stencil is increased. By the friction of contact between the cushion-like linear protuberance and the stencil being increased, the supporting force by the linear protuberance against the leading end of the stencil, is correspondingly increased, whereby the support of the leading end of the stencil is more uniformalized over the width of the stencil.

When the leading end of the stencil is mounted to the printing drum, the position of the leading end of the stencil is determined by the operation of a stencil sheet supply and perforation means which draws out a stencil sheet from a roll thereof, perforates the drawn out stencil sheet and feed out the perforated stencil toward the printing drum. Therefore, it is desirable that the stencil leading end mounting device is always positioned at a correct position when it receives the leading end of the stencil. Therefore, it is desirable that the rotational position of the printing drum is correctly determined when the leading end of the stencil is mounted to the printing drum. Although various means may be employed to correctly determine the rotational position of the printing drum for mounting the leading end of the stencil thereto, considering that the stopping position of the printing drum is delicately affected by the rotational inertia of the total mass of the printing drum, it is more desirable that the rotational position of the printing drum for mounting the leading end of the stencil thereto is precisely determined with respect to the stencil leading end mounting device. In view of these, it is considered that the movement of the clamp member from the open position to the closed position thereof may be utilized to provide a means for positioning the rotational position of the printing drum for mounting the leading end of the stencil thereto.

BRIEF DESCRIPTION OF THE DRAWINGS

In the accompanying drawing.

DESCRIPTION OF THE PREFERRED EMBODIMENTS

In the following the present invention will be described in more detail with respect to some preferred embodiments with reference to the accompanying drawing.

Figure 1:
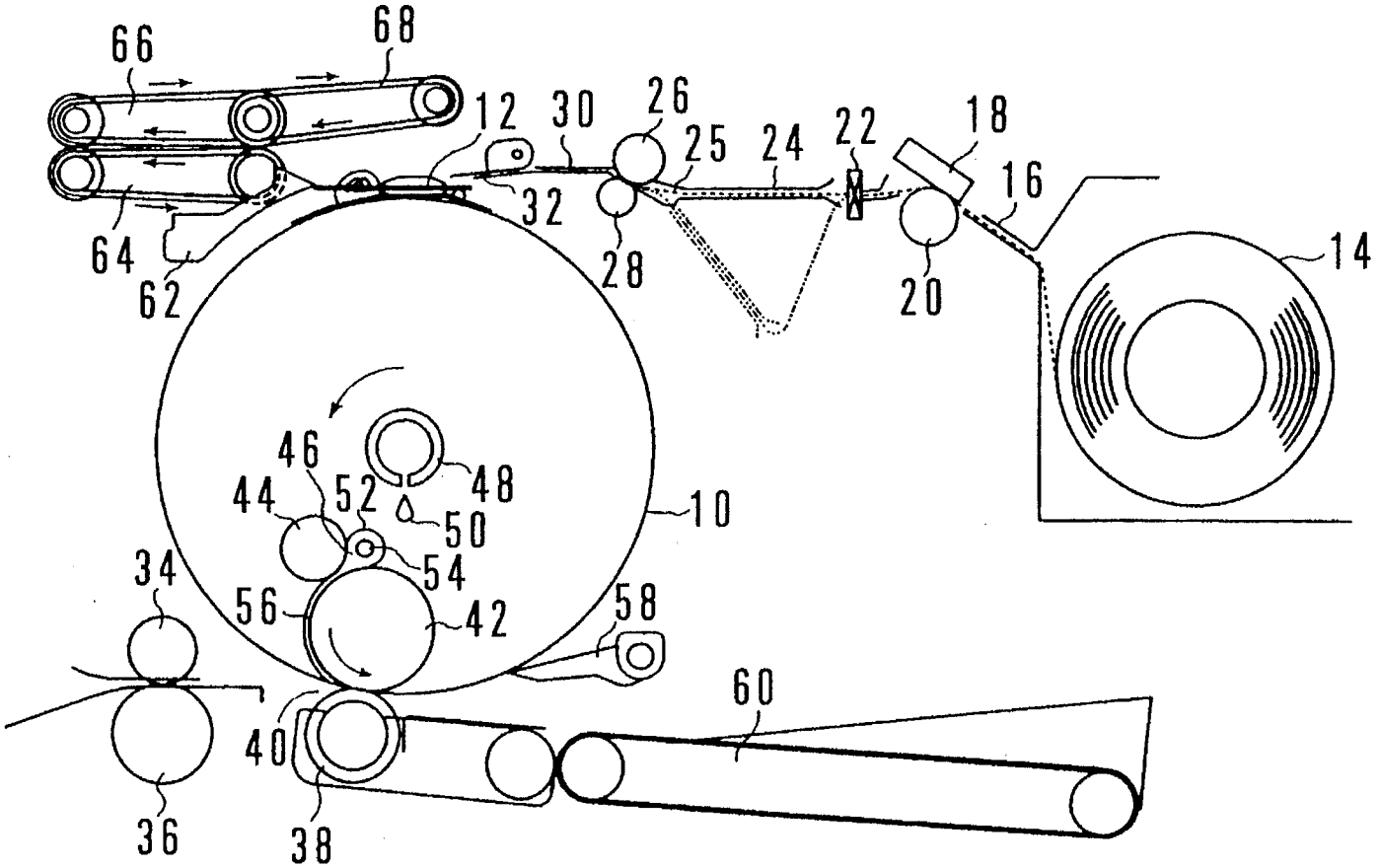
FIG. 1 is a diagrammatic view depicting essential portions of the basic construction of a full automatic rotary stencil printer for the purpose of illustrating the position at which the stencil leading end mounting device according to the present invention is positioned in the full automatic rotary stencil printer.

FIG. 1 is a diagrammatic view depicting essential portions of the basic construction of the full automatic rotary stencil printer in the form of an embodiment, into which the stencil leading end mounting device of the present invention may desirably be incorporated. In the FIG. 10 is a printing drum which is driven to rotate anti-clockwise as shown by an arrow by a printing drum driving means not shown in the figure when a stencil is mounted to the printing drum, also when the printing is carried out, and also when the used stencil is exhausted from the printing drum. The stencil leading end mounting device 12 incorporating the present invention is provided at a part of the printing drum 10. 14 is a roll of a band stencil sheet providing a stencil sheet supply source. The stencil sheet drawn out from the roll 14 is conducted through a guide passage 16, between a thermal head 18 and a platen roller 20, said thermal head 18 perforating the stencil sheet to form a stencil according to image data based upon an electric image data signal supplied thereto from an image data processing means not shown in the figure, a cutter 22 in an open state, a movable passage 24 adapted to be positioned horizontal for receiving the leading end of the stencil and thereafter to break down at a break point 25 to be inclined as shown by phantom lines in the figure for giving an allowance in the feed of the stencil, and between stencil feed rollers 26 and 28 which feed the stencil so that the leading end thereof proceeds into the stencil leading end mounting device 12 under a controlled feed rate through a passage 30 and a movable stencil guide lip 32. After the leading end of the stencil has been fastened by the stencil leading end mounting device 12, the succeeding part of the stencil perforated by a further operation of the thermal head 18 is first slackened for each predetermined length corresponding to a stroke of swing of the movable passage 24 about the break point 25, while the printing drum 10 is intermittently driven in synchronization therewith to take up each allowance provided the slackened stencil so that the stencil is gradually mounted around the printing drum 10. The stencil feed rollers 26 and 28 are put into idling, after the leading end of the stencil has been fastened by the stencil leading end mounting device 12. When a predetermined amount of stencil has been fed, the cutter 22 is operated to cut out a sheet of stencil from the continuous band stencil sheet.

When a sheet of perforated stencil has been mounted around the printing drum 10, the printer proceeds to a printing process, wherein print sheets are successively supplied from a print sheet supply tray not shown in the figure and are fed through between print sheet feed rollers 34 and 36 to a nipping region 40 between the printing drum 10 and a press roller 38. A squeeze roller 42 is provided in the printing drum 10 to oppose the nipping region and to be driven anti-clockwise as shown by the arrow in the figure in synchronization with the rotation of the printing drum 10. A doctor rod 44 is provided adjacent the squeeze roller 42 to define a groove 46 to hold an ink deposit 52 formed by ink 50 supplied from an ink distributor 48. An agitation rod 54 is provided in the groove 46 at a central position thereof to provide a core of the ink deposit 52, so that the ink deposit 52 forms a rotating mass of ink rotating clockwise around the agitation rod 54 when the squeeze roller 42 rotates anti-clockwise as viewed in the figure, with a part of the rotating mass of ink being successively drawn out therefrom in the form of an ink layer 56 carried on the squeeze roller 42 to be supplied to the inner circumferential surface of the printing drum 10, this ink being further passed through the perforations of the stencil mounted around the printing drum 10 and transferred onto the print sheet fed through the nipping region 40 to form a stencil print image on the print sheet. The print sheet thus applied with the stencil printing tends to move along the outer circumferential surface of the printing drum 10 due the adhesiveness of the ink, but the print sheet is removed from the outer circumferential surface of the printing drum as peeled off therefrom by a print sheet removal claw 58 and is transferred by a belt conveyer type print sheet discharge means 60 toward a printed sheet receiving tray not shown in the figure.

When the stencil mounted around the printing drum 10 is to be exhausted, the stencil leading end mounting device 12 is operated in a manner described in detail hereinbelow, so that the leading end of the stencil is released from the clamping by stencil leading end mounting device 12 and is brought into a state freely placed thereon. Then the printing drum 10 rotated in the direction shown by the arrow for the exhausting of the stencil such that the leading end of the stencil is scooped up by a stencil removal claw 62 when it traverses the tip end of the claw and is then bitten into between belt conveyers 64 and 66 of a stencil exhausting means, each of which is moving in the direction shown by an arrows, thus the stencil being successively peeled off from the printing drum 10 as the printing drum 10 is further rotated, to be finally exhausted into a stencil exhaust box positioned on the left side of the belt conveyers 64 and 66 though not shown in the figure. A belt conveyer 68 operates to guide the leading end of the stencil toward a nipping region between the belt conveyers 64 and 66 if the leading end of the stencil would divert away from the nipping region.

The construction and the operation of the stencil leading end mounting device 12 will now be described with reference to FIGS. 2–7 and FIGS. 8*a*–8*h*. In these figures, FIGS. 2, 3 and 4 and corresponding FIGS. 8*a*, 8*b* and 8*c* show three states of the stencil leading end mounting device 12 in the process of mounting the leading end of a new stencil thereto, i.e. before mounting, being mounted and after mounting, while FIGS. 5, 6 and 7 and corresponding FIGS. 8*d*, 8*e* and 8*f* show three states of the same stencil leading end mounting device in the process of releasing the leading end of the stencil from the clamped condition. Further, FIGS. 8*g* and 8*h* show further two states in the stencil exhausting process. The stencil leading end mounting device 12 comprises a base member 72 having a band surface 70 extending along a portion of the cylindrical outer surface of the printing drum 10 in parallel with the central axis thereof and incorporating a magnet piece (desirably a rubber magnet piece) planted in the band surface, and a clamp member 76 having a clamping surface 74 and movable between a closed position (the position shown in FIG. 2 and FIG. 8*a*) where the clamping surface is laid over the stencil leading end supporting surface 70 and an open position (the position shown in FIG. 3 and FIG. 8*b*) where the clamping surface is removed from the stencil leading end supporting surface 70. The clamp member 76 is a plate element of a magnetic material having an elongated rectangular shape extending in parallel with the central axis of the printing drum, and is pivotably supported at longitudinally opposite end portions by a pair of bearing means 78 mounted to the base member 72 so as to be movable between the above-mentioned closed and open positions. The clamp member 76 is constantly magnetically attracted toward the closed position by the above-mentioned magnet piece. The clamp member 76 has a plurality of ribs 80 spaced along the upper surface of the plate element forming the principal portion of the clamp member. The function of these ribs will be described in detail hereinbelow. Further, the plate element forming the principal portion of the clamp member includes a lever portion 82 at one longitudinal end thereof.

The stencil leading end mounting device 12 further comprises a snap-up member 88 which, in the shown embodiment, is formed of a rod element 84 and a pair of arm elements 86 firmly mounted at opposite ends of the rod element. The snap-up member is movable such that the part formed by the rod element 84 moves between a first position close to the inlet edge 90 of the stencil leading end supporting surface 70 (the position shown in FIG. 2 and FIG. 8*a*) and a second position close to the inlet edge 92 of the clamping surface 74 of the clamp member 76 positioned at the open position thereof (the position shown in FIG. 6 and FIG. 8*e*) in relation to supply/exhaust of the stencil. The pair of arm elements 86 are pivotably supported by a pair of bearing means 94 mounted to the base member 72 so that the rod element 84 is movable between the first and second positions. The pair of arm elements 86 are each a plate element made of a magnetic material and are constantly magnetically attracted by the above-mentioned magnet piece just as the clamp member 76 is, such that when the rod element 84 is at the first position, the pair of arm elements 86 are seated on the stencil leading end supporting surface 70. One of the pair of arm elements 86 includes a lever portion 96 extending to the opposite side of the bearing means 94 relative to the rod element 84.

Thus the clamp member 76 is biased around the bearing means 78 toward to closed position by the magnetic attraction of the above-mentioned magnet piece, and when the clamp member 76 is at the closed position, the clamping surface 74 of the clamp member is pressed against the stencil leading end supporting surface 70 under a predetermined pressing force. The snap-up member 88 formed of the rod element 84 and the pair of the arm elements 86 is also biased about the bearing means 94 toward the first position by the magnetic attraction force of the magnet piece. And now there are provided means for pivoting the clamp member 76 biased to the closed position toward the open position against the biasing force of the magnet piece and means for pivoting the snap-up member 88 from the first position toward the second position against the biasing force of the magnet piece. These means are actuating means comprising a pulse motor 98 having a shaft 100, first and second cams 102 and 104 supported by the shaft 100, first and second lever members 108 and 110 adapted be pivoted about a pivot shaft 106 by those cams, and tension coil springs 112 and 114 biasing those lever members about the pivot shaft 106.

In this connection, as the means for magnetically attracting and holding the clamp member 76 and the snap-up member 88 to the stencil leading end supporting surface 70 of the base member 72, the abovementioned magnet piece planted in the base member may be replace by a magnet plate firmly mounted over the base member 76 by an adhesive, screws, etc. to provide the whole stencil leading end supporting surface 70.

The cam 102 has first cam portion 102*a* and a second cam portion 102*b* displaced from one another for 180° around the central axis of the pulse motor shaft 100 to be opposite to one another while the cam 104 has a single cam portion 104*a* angularly shifted relative to the cam portions 102*a* and 102*b* as shown in the figures. The pulse motor shaft 100 rotates clockwise when viewed in FIG. 2 from this and left side therein.

In the following, the operation of the stencil leading end mounting device 12 will be described.

Figure 2:
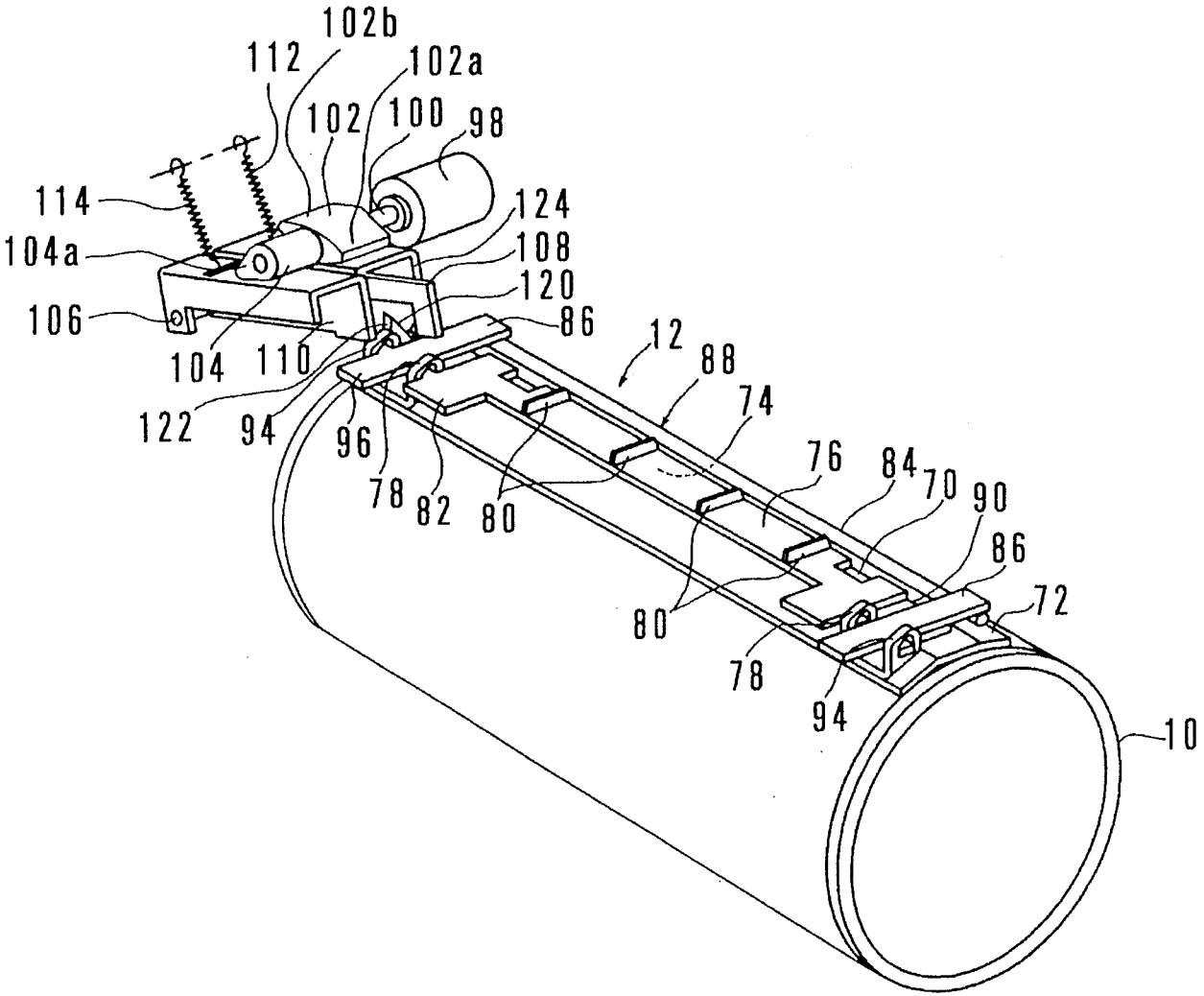
FIG. 2 is a perspective view showing essential portions of the printing drum means incorporating an embodiment of the stencil leading end mounting device according to the present invention.

First, at the starting of the operation of the stencil printer where no leading end of the stencil is yet mounted to the stencil leading end mounting device 12, the respective portions of the device are in the state depicted in FIG. 2 and FIG. 8*a*. In this connection, however, it is to be noted that in this kind of rotary stencil printer, except when a new machine is going to be first started, it is the general practice that, when the stencil printing by a sheet of stencil has been completed, the used stencil is left in the mounted condition until the next printing by the next sheet of stencil is started, to avoid the drying up of the ink contained in the circumferential wall of the printing drum while the stencil printer is at rest. Therefore, generally, prior to starting of the printing operation by a new stencil, prior to the perforation of the new stencil or in parallel therewith, the process of exhausting the used stencil from the printing drum is carried out. Therefore, the condition shown in FIG. 2 and FIG. 8*a* as the starting condition is the condition where such a prior stencil exhausting process has been finished. In this state, neither of the cams 102 and 104 are pressing the lever elements 108 and 110 downward, so that the lever members 108 and 110 are turned up around the pivot shaft 106 to the respective highest position by the action of the springs 112 and 114, so that the lever portion 82 of the clamp member 76 and the lever portion 96 of the snap-up member 88 are both released from the pressing action by the lever members 108 and 110, respectively, so that the clamp member 76 is at the closed position with the clamping surface 74 being laid over the stencil leading end supporting surface 70 of the base member 72, while the snap-up member 88 is at the first position with the rod element 84 being positioned close to the leading edge 90 of the stencil leading end supporting surface 70.

Figure 3:
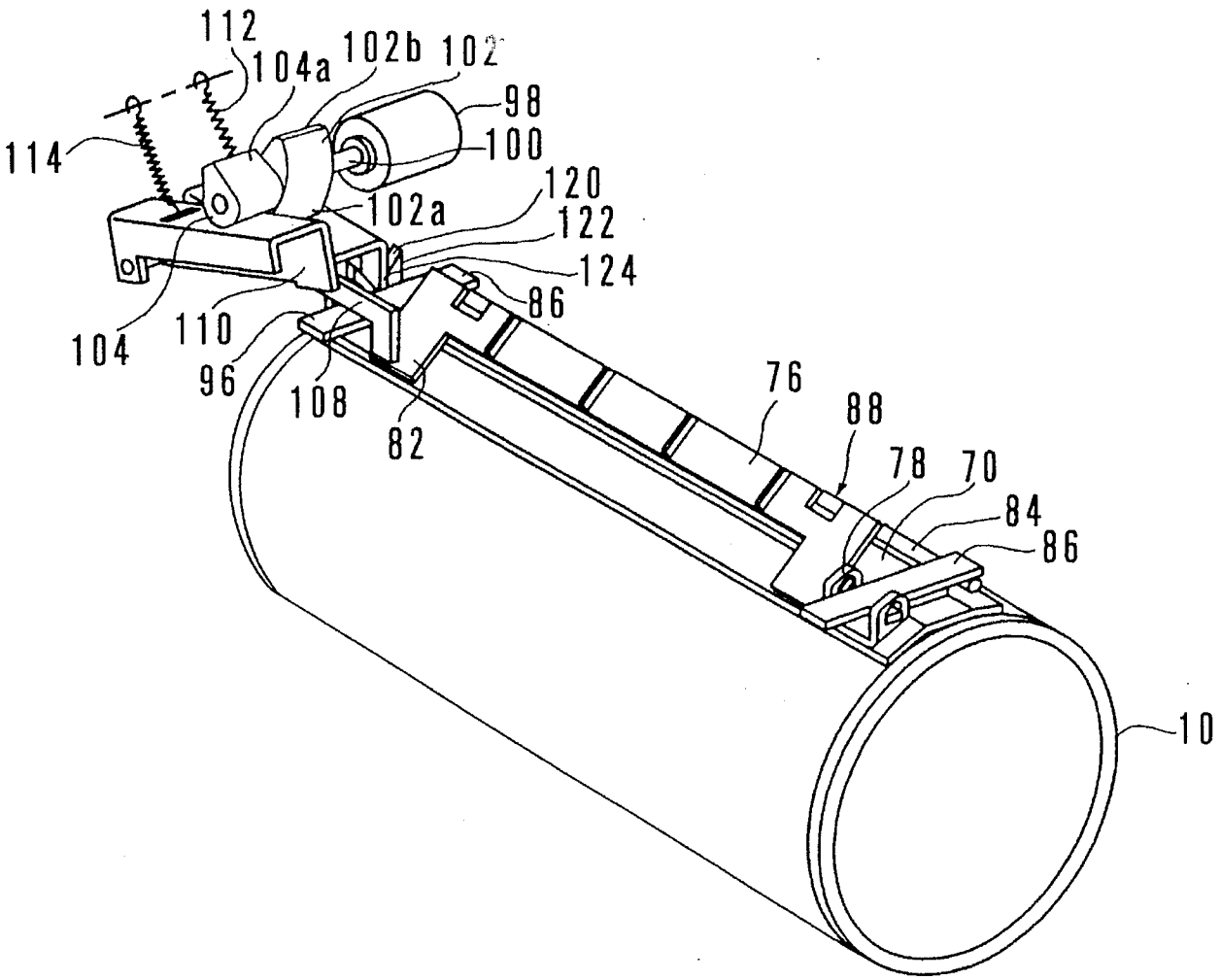
FIG. 3 is a perspective view showing the printing drum means shown in FIG. 2 in another operating condition.

When there comes a time that the leading end of a stencil is to be mounted to the stencil leading end mounting device 12, the respective portions of the device take the state shown in FIG. 3 and FIG. 8*b*, wherein the cams 102 and 104 turn to the positions shown in FIG. 3, so that the lever member 108 is turned around the pivot shaft 106 downward by the cam portion 102*a* of the cam 102 against the action of the spring 112, so that the tip end of the lever member 108 pushes the lever portion 82 of the clamp member 76 against the magnetic attraction force acting thereto from the magnet piece, so that the clamp member 76 is turned around the pair of bearings 78 as shown in FIG. 3, such that the clamping surface 74 makes such a space against the stencil leading end supporting surface 70 of the base member 72 as shown in FIG. 8*b* which is suitable for taking in the leading end 116 of the stencil approaching thereto from the right side in the figure.

When the pulse motor 98 turns its shaft 100 further, the cams 102 and 104 are brought to the state shown in FIG. 4 where again none of these cams press the lever members 108 and 110, so that the respective portions of the device take the state shown in FIG. 4 and FIG. 8*c*, wherein the clamp member 76 is positioned at the closed position with the clamp member 76 laid over the stencil leading end supporting surface 70 of the base member 72. Therefore, the leading end 116 of the stencil having proceeded between the stencil leading end supporting surface 70 and the clamping surface 74 is clamped therebetween, and held in the clamped state under the magnetic attraction force of the magnet piece acting to the clamp member 76. Thereafter, as already described with reference to FIG. 1, the printing drum 10 is rotated in the direction shown by the arrow, with progress of the perforation of the stencil by the thermal head 18, so that the stencil is gradually intermittently mounted around the printing drum 10 starting from the leading end thereof mounted to the stencil leading end mounting device 12, until such a perforation/mounting transfer of the stencil reaches a predetermined length, and then the cutter 22 is operated to cut off a piece of stencil from the band sheet of stencil, thus finishing the mounting process of the stencil around the printing drum 10. Then, the printing process is carried out as described above.

Figure 4:
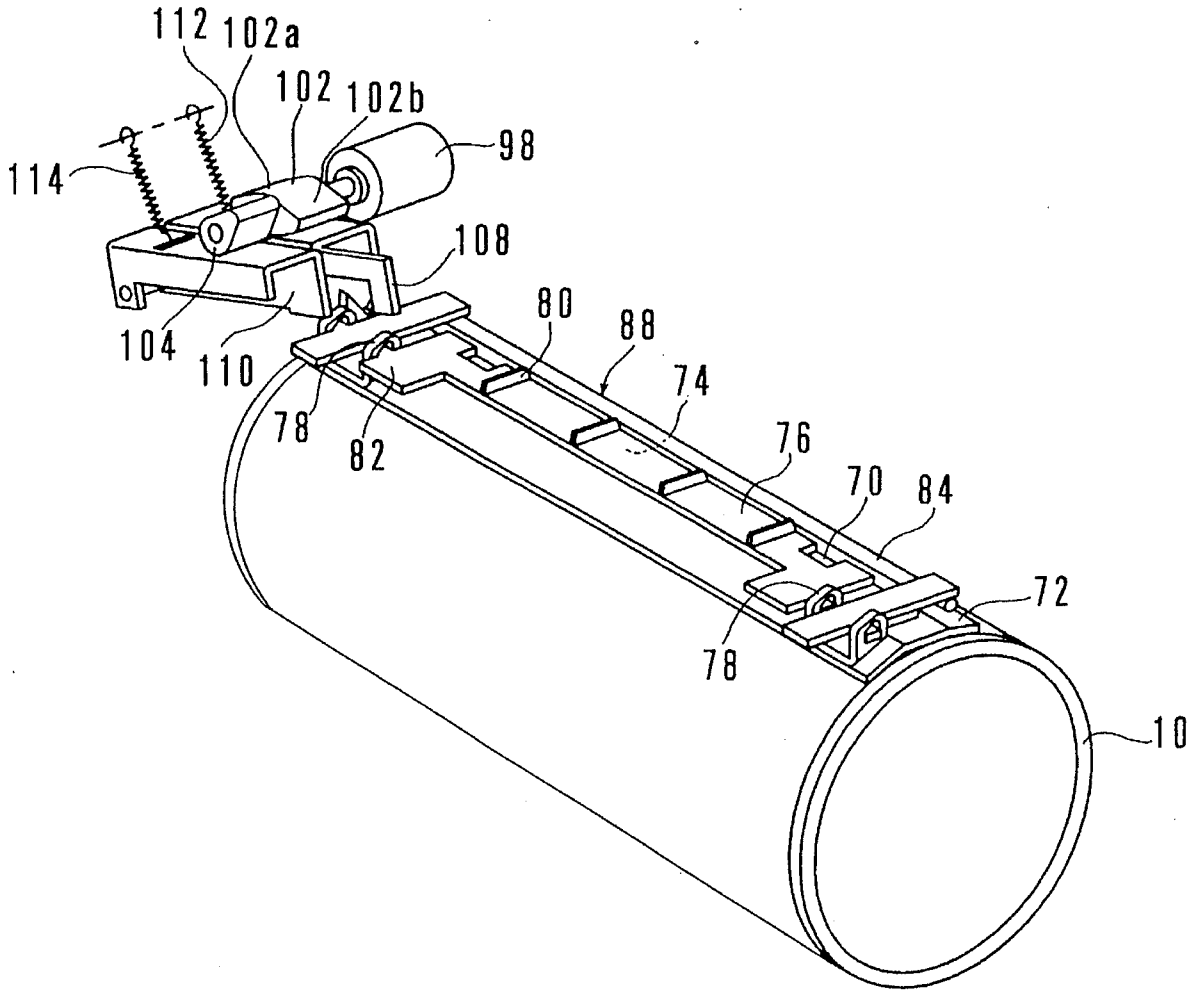
FIG. 4 is a perspective view showing the printing drum means shown in FIG. 2 in still another operating condition.
Figure 5:
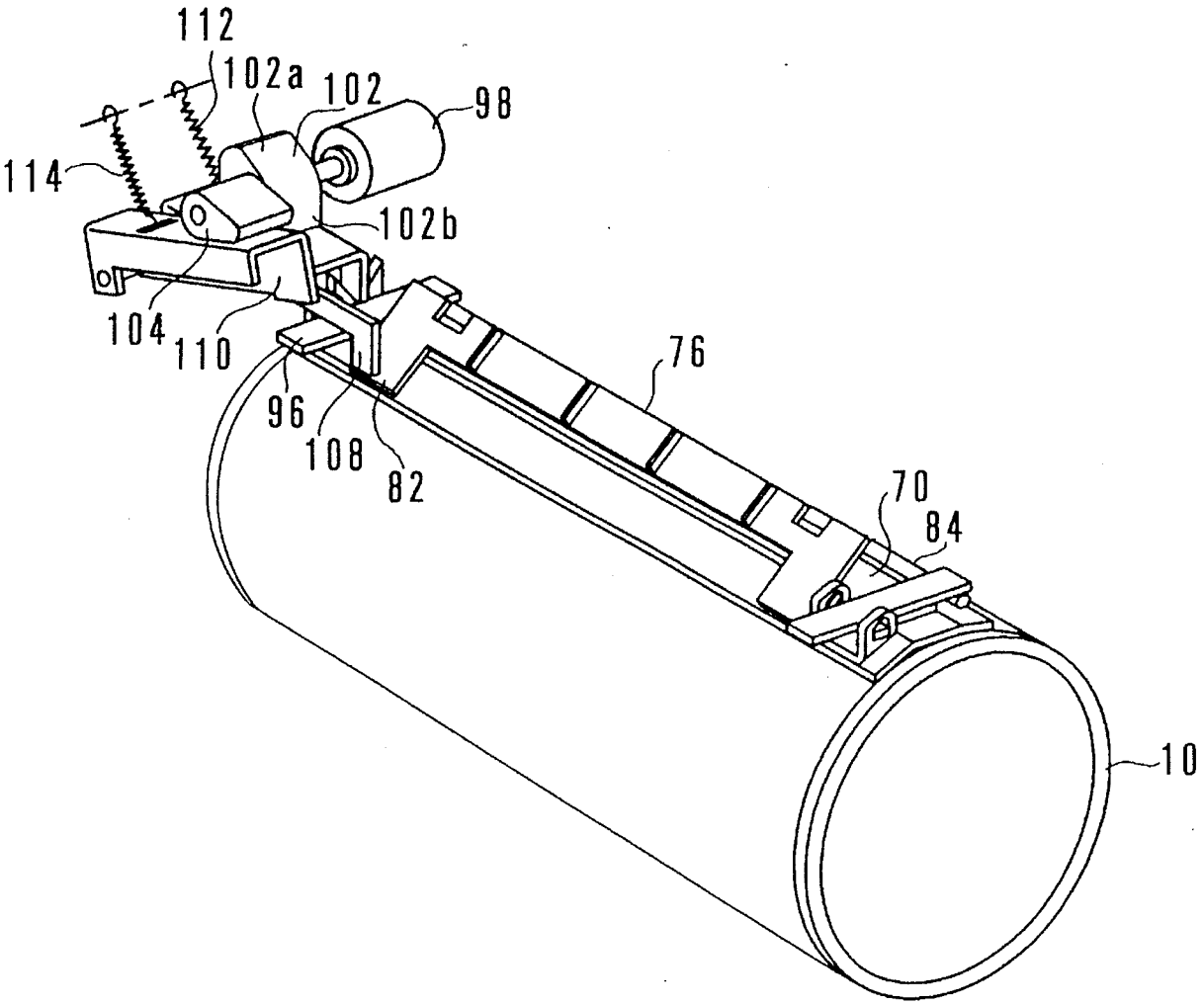
FIG. 5 is a perspective view showing the printing drum means shown in FIG. 2 in still another operating condition.

After a required printing operation had been finished, and after the used stencil has been left as mounted around the printing drum, when the used stencil is to be removed from the printing drum 10 prior to the next printing by a new stencil, the pulse motor 98 is further rotated from the state shown in FIG. 4 so that cams 102 and 104 take the positions as shown in FIG. 5. In this state, the cam portion 102*b* of the cam 102 pushes the lever member 108 downward so that the clamp member 76 is turned up from the closed position shown in FIG. 8*c* toward the open position against the magnetic attraction force of the magnet piece to take the state shown in FIG. 5 and FIG. 8*d*, whereby the leading end 116 of the stencil is released as shown in FIG. 8*d* from the prior condition clamped between the stencil leading end supporting surface 70 and the clamping surface 74, although the leading end of the stencil is still laid below the clamp member 76 so that it can not yet move beyond the clamp member toward the stencil exhausting means.

Figure 6:
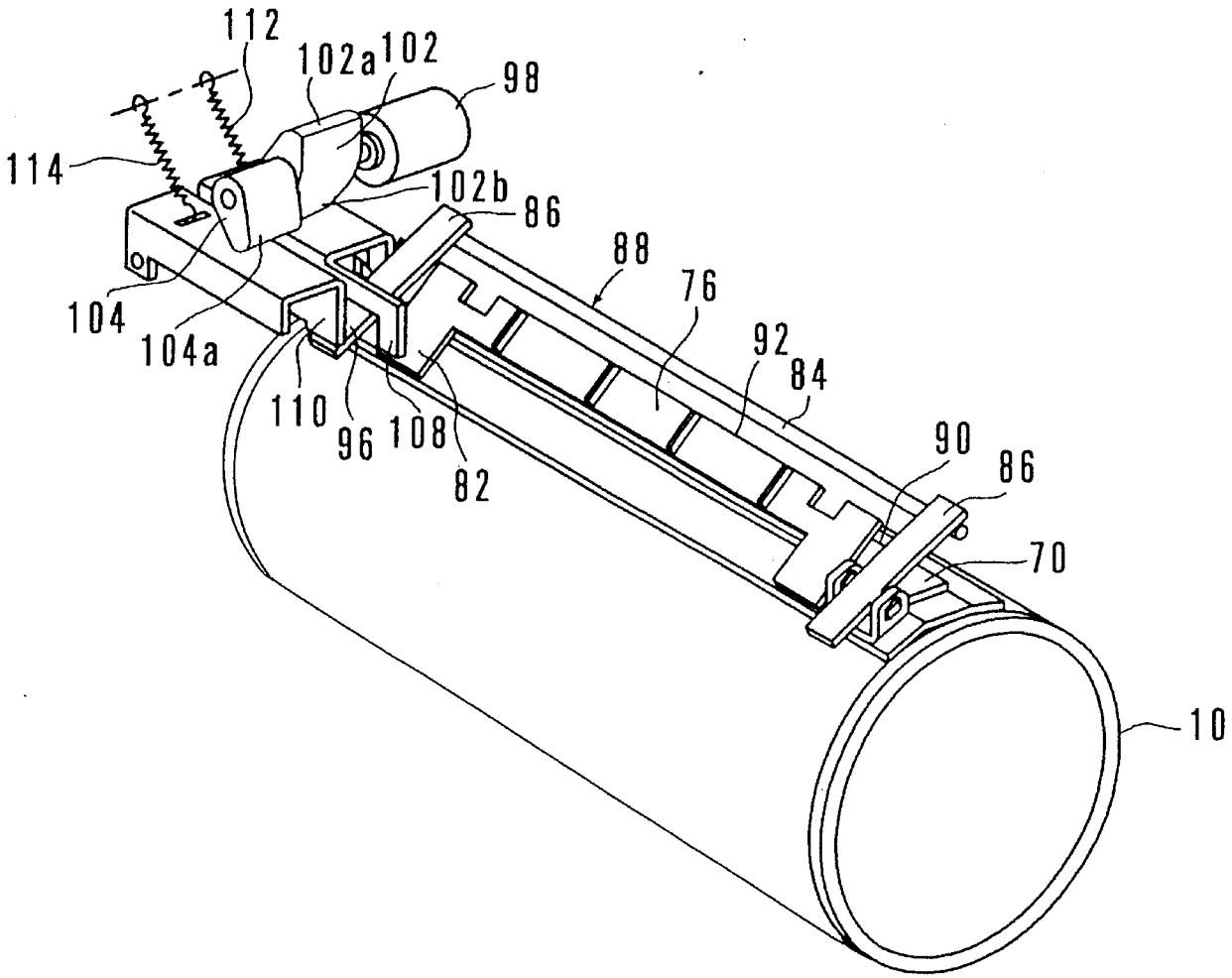
FIG. 6 is a perspective view showing the printing drum means shown in FIG. 2 in still another operating condition.

Then, the pulse motor 98 is further rotated so that the cams 102 and 104 are brought to the rotational positions shown in FIG. 6, whereby the snap-up member 88 is moved from the first position close to the inlet edge 90 of the stencil leading end supporting surface 70 to the second position close to the inlet edge 92 of the clamping surface 74 of the clamp member 76 still maintained at the open position by the cam 102 as shown in FIG. 8*e*. By this action of the snap-up member 88, the leading end 116 of the stencil is brought to the state floated up from the stencil leading end supporting surface 70 as shown FIG. 8*e*.

Figure 7:
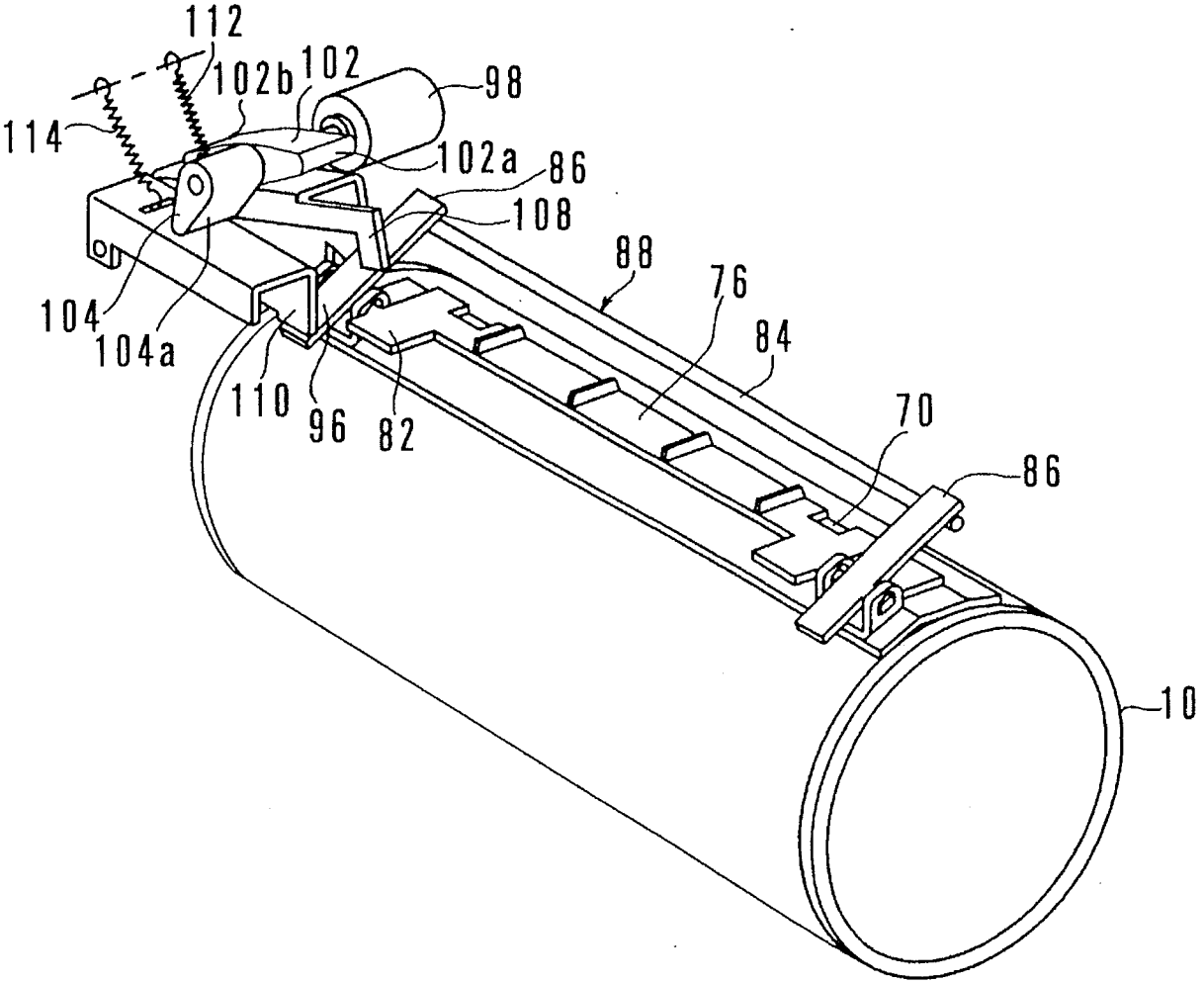
FIG. 7 is a perspective view showing the printing drum means shown in FIG. 2 in still another operating condition.
Figure 8A:
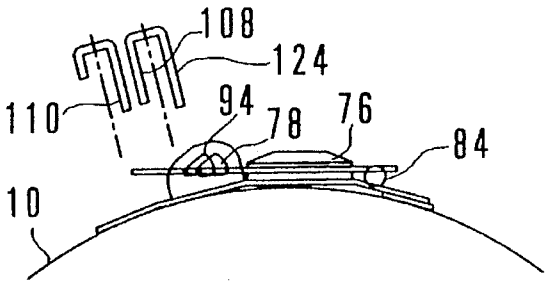
FIGS. 8*a*, 8*b*, 8*c*, 8*d*, 8*e* and 8*f* are diagrammatic side views of the printing drum means, showing it in a series of operating conditions corresponding to those shown in FIGS. 2, 3, 4, 5, 6 and 7, respectively.
Figure 8B:
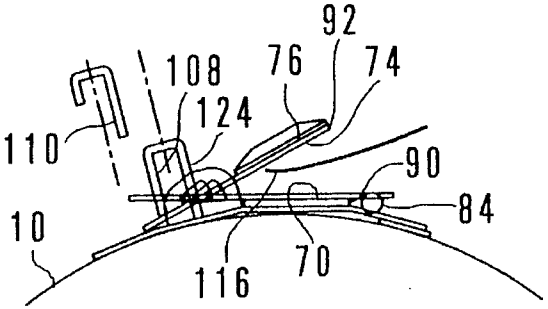
Figure 8C:
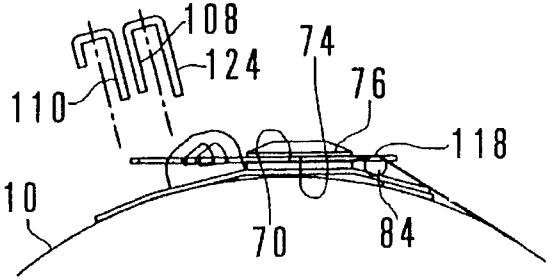
Figure 8D:
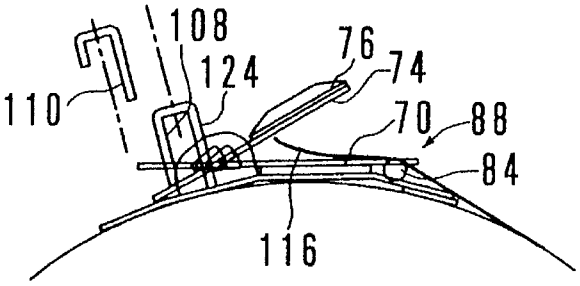
Figure 8E:
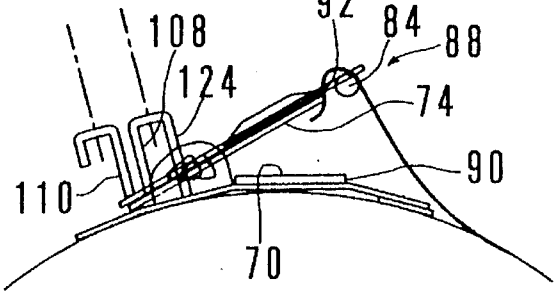
Figure 8F:
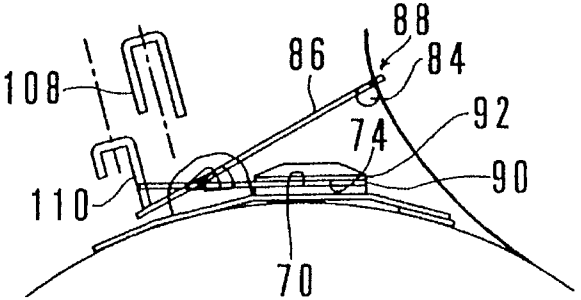
Figure 8G:
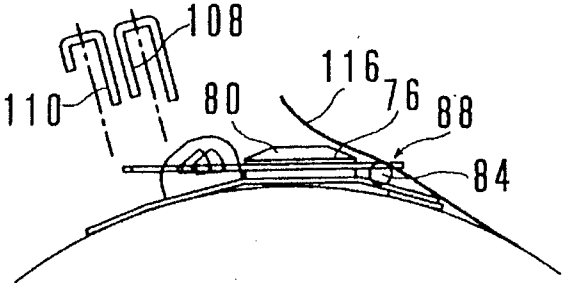
FIGS. 8*g* and 8*h* are similar diagrammatic side views of the printing drum means showing it in further operating conditions following the operating condition shown in FIG. 8*f*.
Figure 8H:
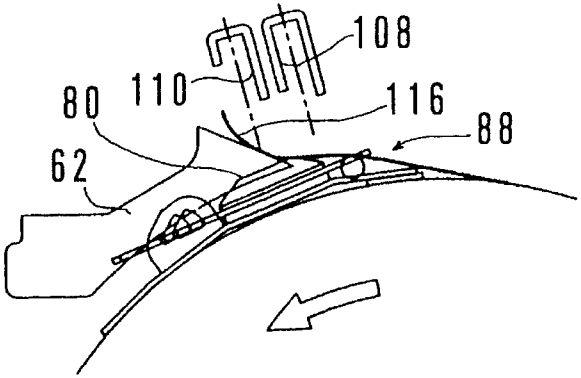

Then, the pulse motor 98 is further rotated so that the cams 102 and 104 come to the positions shown in FIG. 7, whereby the lever member 108 is lifted as released from the pressing action of the cam 102, and in accordance with this the clamp member 76 is returned to the closed position as shown in FIG. 7 and FIG. 8*f*, while the snap-up member 88 is still maintained at the second position. Therefore, the leading end 116 of the stencil moves from the lower side of the clamping surface 74 to the other side of the clamp member 76 (upper side in the figure) by traversing the inlet edge 92 of the clamp member 74 as shown in FIG. 8*f*. Thereafter, as the pulse motor 98 further rotates so far that the cams 102 and 104 take again the positions shown in FIG. 2, the clamp member 76 and the snap-up member 88 are returned to the respective closed and first positions as shown in FIG. 8*g*, wherein, however, the leading end 116 of the stencil is released on the upper side of the clamp member 76.

When the printing drum is further rotated, the tip end of the stencil removal claw 62 gets under the leading end 116 of the stencil to scoop it up as shown in FIG. 8*h*, and then, in the manner described with reference to FIG. 1, the stencil is bitten into between the belt conveyers 64 and 66 of the stencil exhausting means starting from the leading end thereof, so that the stencil is gradually removed from the circumferential surface of the printing drum according to the rotation thereof, and the removed stencil is finally transferred into the stencil exhaust box provided on the left side in the figure but not shown in the figure.

As will be understood from FIGS. 8*g* and 8*h*, the ribs 80 provided at the clamp member 76 operate to support the leading end 116 of the stencil snapped up to the upper side of the clamp member 76 in the condition floating above the plate portion of the clamp member 76, so that when the tip of the stencil removal claw 62 is position to be closer to the central axis of the printing drum than the upper edge of the ribs 80 at an axially mid point between the two adjacent ribs 80, the leading end 116 of the stencil is scooped up by the stencil exhaust claw without fail when the leading end of the stencil traverses the tip end of the stencil removal claw according to the rotation of the printing drum, so that the leading end of the stencil is forwarded toward the nipping region between the belt conveyers 64 and 66.

Although the clamp member 76 and the snap-up member 88 are biased to the respective closed position and first position by the magnetic attraction force of the magnet piece planted in the base member 72 in the shown embodiment, such a biasing force may be provided by any other appropriate means such as an electromagnetic means, spring, etc.

When the snap-up member 88 is so constructed as in the shown embodiment that, when it is at the first position, a linear protuberance bulged out from the stencil leading end supporting surface 70 like a cushion along the inlet edge 90 thereof, as will be understood from FIG. 8*c*, when the leading end of the stencil is clamped between the stencil leading end supporting surface 70 and the clamp member 74, the leading end of the stencil is raised around the cushion-like linear protuberance 118 provided by the rod element 84 at the outlet of the clamping surface 74 and is tangentially expanded toward the outer circumferential surface of the printing drum, whereby the stencil is applied with a strong friction by an arcuate contact with the linear protuberance 118, whereby the stencil is applied with a width wise uniform squeezing action so that the mounting action of the leading end of the stencil is uniformalized over the whole width of the stencil. In order to increase such a squeezing action applied to the stencil by the linear protuberance 118 provided by the rod element 84 can be increased to accomplish a more width wise uniform and definite mounting of the leading end of the stencil by applying a chemical surface roughing treatment or a mechanical surface roughing treatment such as filing to a surface portion of the rod element 84 which is contacted by the leading end of the stencil. Or such a surface roughing may be done by attaching fine hard particles to the surface of the rod element 84 by an adhesive or the like.

The mounting of the leading end of the stencil to the stencil leading end mounting device according to the processes shown in FIGS. 8*a*, 8*b* and 8*c* and the release of the leading end of the stencil from the stencil leading end mounting device as shown by FIGS. 8*d*, 8*e*, 8*f* and 8*g* are carried out when the printing drum is positioned at a predetermined rotational position where the stencil leading end mounting device is positioned at approximately the highest position thereof. In this connection, it is desired that particularly for the mounting of the stencil leading end to the stencil leading end mounting device that the stencil leading end mounting device is positioned precisely at a predetermined position, or the printing drum 10 is stopped precisely at a predetermined rotational position. Although any means may be employed to stop the printing drum precisely at a predetermined rotational position, the embodiment of the stencil leading end mounting device of the present invention can incorporate a means for positioning itself precisely at a predetermined position. The stencil leading end mounting device positioning means comprises a cam plate 122 having a V-shaped cam groove 120 and mounted at an axial end portion of the printing drum 10, and a cam actuation means 124 mounted at a side portion of the lever member 108. The operation of the stencil leading end mounting device positioning means is depicted in FIG. 9*a*–9*d*.

Figure 9A:
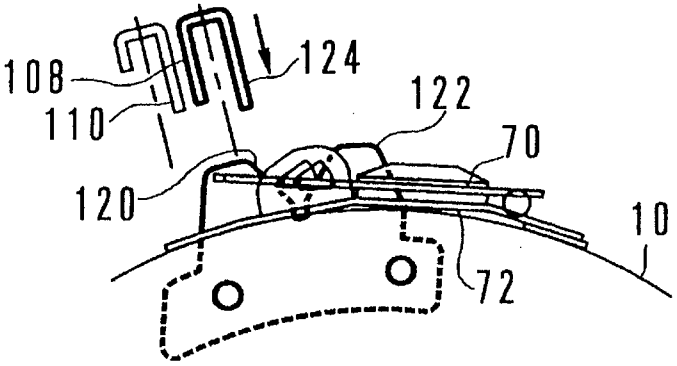
FIGS. 9*a*, 9*b*, 9*c* and 9*d* are diagrammatic side views showing the means for precise and fine adjustment of the stop position of the printing drum for the operation of the stencil leading end mounting device incorporated in the printing drum means shown in FIG. 2 and others in a series of operating conditions thereof at the time of mounting the leading end of the stencil.

The operating condition shown in FIG. 9*a* corresponds to the condition shown in FIG. 2 and FIG. 8*a*. Although the printing drum 10 was stopped at as precisely a predetermined rotational position as possible by the control of the driving means of the printing drum, the printing drum has yet been actually stopped as slightly shifted from the predetermined position under the influence of the rotary inertia of the printing drum, etc.

Figure 9B:
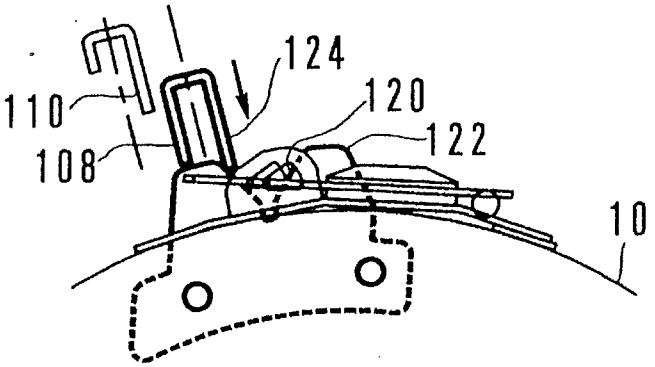
Figure 9C:
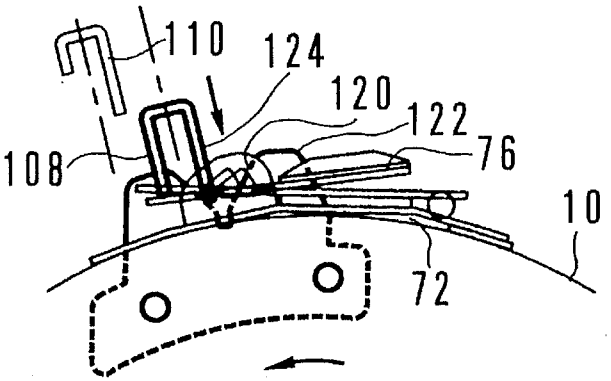
Figure 9D:
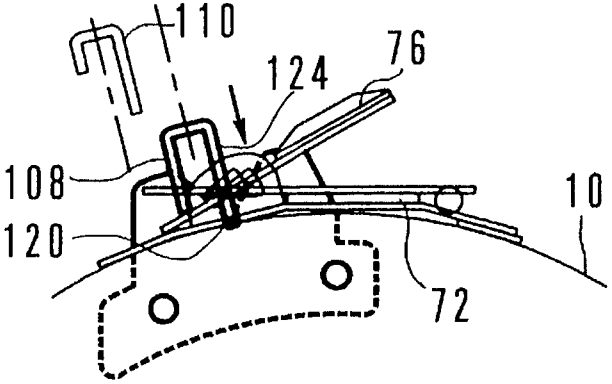

Starting from such a condition, the cam 102 is driven from the position shown in FIG. 2 to the position shown in FIG. 3 by the operation of the pulse motor 98 as described above, whereby the lever member 108 is pushed down which in turn pushes down the lever portion 82 of the clamp member 76 to turn the clamp member 76 toward the open position shown in FIG. 3 and FIG. 8*b*. During this process the cam operating portion 124 formed as integral with the lever member 108 at one side thereof engages a side edge of the V-shaped cam groove 120 as shown in FIG. 9*b* in a manner which will vary according to each difference of the stop position of the printing drum from the predetermined standard stop position thereof, but in any event, as the cam operating portion 124 is pushed down, the engagement of the cam operating portion 124 and the cam groove 120 turns the printing drum 10 in a direction such as shown by an arrow in FIG. 9*c*, so that by the time when the clamp member 76 is finally opened by the lever member 108, the cam operating portion 124 reaches the bottom point of the cam groove 120 as shown in FIG. 9*d*, positioning the base member 72 and the clamp member 76 of the stencil leading end mounting device precisely to the predetermined standard position as shown in FIG. 8*b*, to be ready for accepting the leading end 116 of the stencil.

The positioning of the stencil leading end mounting device or the fine adjustment of the stop position of the printing drum by the cam groove 120 and the cam operating portion 124 described above is also carried out when the lever member 108 is driven downward by the cam portion 102*b* of the cam 102 as shown in FIG. 5 and FIG. 8*d* in the process of releasing the leading end of the stencil from the stencil leading end mounting device for exhausting the stencil. Therefore, in the shown embodiment, the precise positioning of the stencil leading end mounting device is accomplished by the cam groove 120 and the cam operating portion 124 also at the time of exhausting the stencil.

Although the present invention has been described in detail with respect to some preferred embodiments thereof, it will be apparent for those skilled in the art that the present invention is not limited to the shown embodiments and other various embodiments are possible based upon the technical concept of the present invention.

We claim:

1. A device for mounting a leading end of a stencil in a rotary stencil printer, said printer having a printing drum equipped with a base member having a band surface extending along a portion of a cylindrical outer surface of said printing drum in parallel with a central axis thereof for supporting said leading end of the stencil thereon, and a clamp member having a clamping surface and movable between a closed position where said clamping surface is laid over said stencil leading end supporting surface and an open position where said clamping surface is removed from said stencil leading end supporting surface, so that the leading end of the stencil is inserted into a space left between said stencil leading end supporting surface of said base member and said clamping surface of said clamp member across a inlet edge of each of said surfaces when said clamp member is in said open position and is then clamped between said stencil leading end supporting surface of said base member and said clamping surface of said clamp member when said clamp member is moved to said closed position, said device comprising a snap-up member movable between a first position located close to the inlet edge of said stencil leading end supporting surface and a second position close to the inlet edge of said clamping surface of said clamp member positioned at said open position in relation to the movement of said clamp member between said closed and open positions and supply/discharge of the stencil, so that, when the leading end of the stencil is inserted into the space left between said stencil leading end supporting surface and said clamping surface to be mounted to said base member, said snap-up member is positioned at said first position to be on a same side of the leading end of the stencil as said stencil leading end supporting surface, and when clamp member moves to remove said clamping surface away from said stencil leading end supporting surface for releasing the leading end of the stencil clamped between said stencil leading end supporting surface and said clamping surface to exhaust the stencil, said snap-up member moves to said second position so as, at least temporarily, to face a first side of said clamp member opposite to a second side thereof where said clamping surface is provided, thereby moving the leading end of the stencil to said first side of said clamp.

2. A device for mounting a leading end of a stencil in a rotary stencil printer according to claim 1, wherein said snap-up member comprises a rod portion which provides a linear protuberance bulging from said stencil leading end supporting surface like a cushion along the inlet edge thereof when said snap-up member is positioned at said first position.

3. A device for mounting a leading end of a stencil in a rotary stencil printer according to claim 2, wherein said rod portion providing said linear protuberance has a surface processed by a surface roughing treatment to increase the friction coefficient thereof in contact with the stencil.

4. A device for mounting a leading end of a stencil in a rotary stencil printer according to claim 1, further comprising a means adapted to move in relation to the movement of said clamp member from said open position to said closed position to rotationarily position said printing drum at a predetermined rotational position.

* * * * *